US005814273A

United States Patent [19]

Nielsen

[11] Patent Number: 5,814,273

[45] Date of Patent: Sep. 29, 1998

[54] TRUNNION LINER APPARATUS

[76] Inventor: Jack T. Nielsen, 3330 S. 8000 West, Magna, Utah 84044

[21] Appl. No.: 835,152

[22] Filed: Apr. 4, 1997

[51] Int. Cl.[6] ..... B02C 17/14

[52] U.S. Cl. ..... 266/168; 241/182; 241/300

[58] Field of Search ..... 266/168, 280; 241/182, 179, 300, 70

[56] References Cited

U.S. PATENT DOCUMENTS

| | | | |
|---|---|---|---|
| 1,018,320 | 2/1912 | Holthoff | 241/300 |
| 1,053,084 | 2/1913 | Capen | 241/300 |
| 3,401,893 | 9/1968 | Reynolds | 241/300 |
| 3,604,369 | 9/1971 | Jenness | 241/182 |
| 3,604,637 | 9/1971 | Sabaski | 241/300 |
| 3,746,268 | 7/1973 | Kastrinos | 241/179 |
| 4,441,659 | 4/1984 | Marklund | 241/70 |

*Primary Examiner*—Scott Kastler
*Attorney, Agent, or Firm*—Foster & Foster

[57] ABSTRACT

A trunnion liner apparatus includes a main body portion in the form of a rubber boot which forms a main pocket and a pair of cavities. A magnetic block is held within the main pocket for attaching the trunnion liner directly to an inside surface of a trunnion. The pair of upper cavities are sized to hold a layer of material to prevent wear on an inside surface of a trunnion. In one embodiment, the layer of material comprises a plurality of steel balls and processed material interdispersed between the steel balls.

16 Claims, 3 Drawing Sheets

TRUNNION LINER APPARATUS

TECHNICAL FIELD

This invention relates to protective devices which serve as liners for the inside of materials handling equipment, and more particularly, to protective liners used to cover a trunnion positioned between a ball mill and a trommel.

BACKGROUND OF THE INVENTION

Trunnions used in materials handling systems are susceptible to a high amount of wear. Trunnions are used between two materials handling stations to move the material being processed from one station to another. The trunnion is generally cylindrical and oriented at an angle so that as the trunnion rotates, the material being processed flows from one location (e.g., a ball mill) to another location (e.g., a trommel). In a milling environment, the material being handled is reduced in size in the ball mill, after which the trunnion directs the materials that have been crushed into the trommel. A trommel is also generally cylindrical and consists of a series of screens that allow material being processed to fall through the screen (if suitably undersized) and the oversized material to be carried away for further processing. The oversized material is typically directed back into the ball mill.

Given the rotation of the trunnion and the constant flow of material from the ball mill to the trommel, significant wear takes place on the surface of the trunnion contacting the material being processed. Accordingly, various attempts have been made to line trunnion devices with materials that will extend the life of the trunnion. Traditionally, trunnion lining devices have been replaceable.

One known type of trunnion liner apparatus consists of a series of metal plates that are physically coupled to the inside surface of the trunnion. Rivets are commonly used to attach the plates to the inside of the trunnion. Rivets are commonly used to attach the plates to the inside of the trunnion. These plates have typically been made of steel having a certain thickness. Once the thickness of the steel is reduced to an unacceptable level, the trunnion must be shut down for extended periods of time and significant labor is required to remove the old liner material and replace it with new liner material inside the trunnion.

Another problem associated with traditional trunnion liners relates to the physical characteristics of the trunnion. A trunnion is tubularly shaped to form an elongated cavity comprising a frusto-conically shaped area. Accordingly, multiple small liners must be placed around the inside of the trunnion to accommodate the unique physical characteristics of the trunnion. Therefore, when replacement of traditional liners has been required inside the trunnion, many small liner elements must be removed and replaced.

There is a need, therefore, to provide a trunnion liner apparatus that provides suitable and long-lasting protection for the inside surface of the trunnion. Another need exists to provide a trunnion liner apparatus that is easy to replace, requires minimal man hours for replacing, and that is inexpensive to manufacture.

SUMMARY AND OBJECTS OF THE INVENTION

It is a primary object of the invention to provide a trunnion liner apparatus that prevents wear on the inside surface of the trunnion.

Another object of the invention is to provide a trunnion liner apparatus that is easy to replace.

Another object of the invention is to provide a trunnion liner apparatus that requires no fastening devices for securing the trunnion liner to the inside surface of the trunnion.

Yet another object of the invention is to provide a trunnion liner apparatus that utilizes a magnetic force to secure the liner device to the inside surface of the trunnion.

Still another object of the invention is to provide a trunnion liner apparatus that attracts a layer of material against the trunnion liner device to create a buffer between the trunnion liner apparatus and the processed material passing through the trunnion.

The foregoing objects are achieved by a trunnion liner apparatus that is magnetically coupled to the inside surface of a trunnion. While the invention is preferably used in connection with a trunnion interposed between a ball mill and a trommel, the liner of the present invention may be used in connection with various types of materials handling devices where appropriate. The trunnion liner includes a rubber boot having a main pocket sized to hold a magnetic block of material. The magnetic block of material attaches directly to the inside surface of the trunnion. On the surface of the boot opposite the main pocket, a pair of cavities are formed in the boot. The cavities are sized for holding a plurality of steel balls. The balls are held within the twin cavities by means of the magnetic force imparted through the rubber boot from the magnetic block. The trunnion liners are positioned on the inside surface of the trunnion so as to be end to end and side by side with respect to one another. The liners form a continuous matrix that covers the entire inner surface of the trunnion. As the trunnion liner rotates to pass ore from the ball mill to the trommel, processed material becomes compacted between the multiple steel balls above the rubber boot, which creates a lining layer of material against which the material being processed is directed. That is, the material being processed impacts and creates friction with a buffer layer of the same material being processed.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
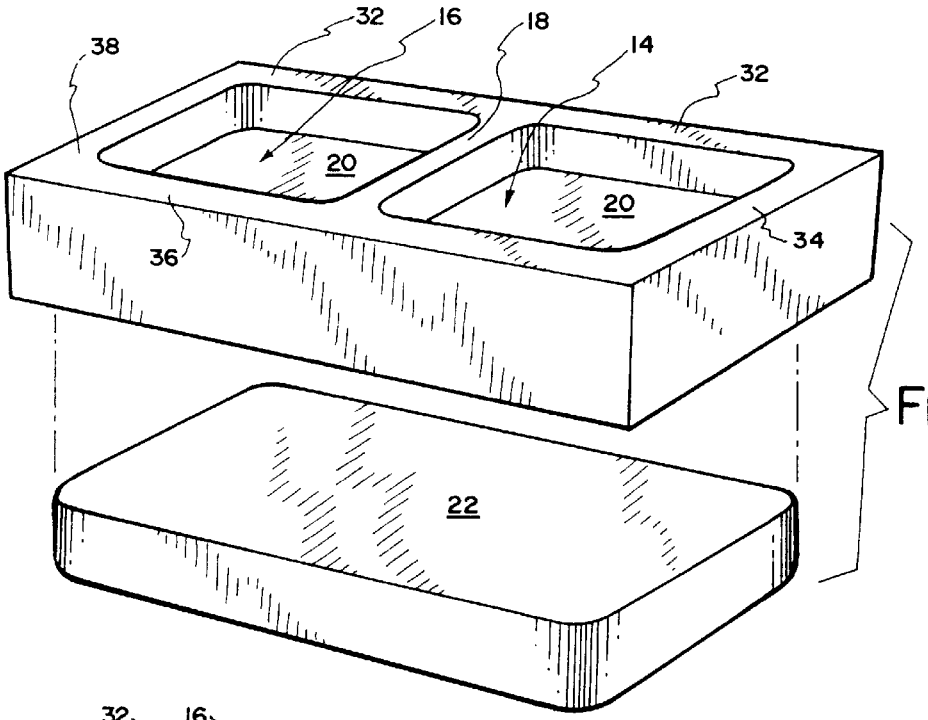
FIG. 1 is an exploded perspective view of the trunnion liner apparatus showing the rubber boot and the magnetic block separated from one another.
Figure 2:
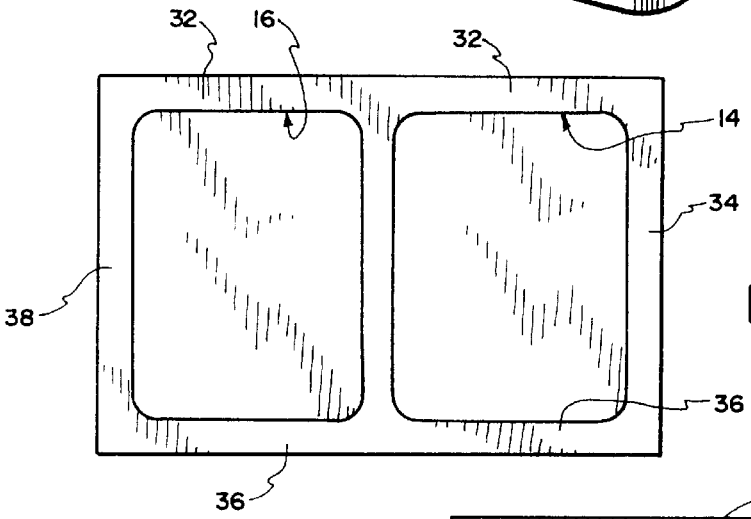
FIG. 2 is a top view of the rubber boot shown in FIG. 1.
Figure 3:
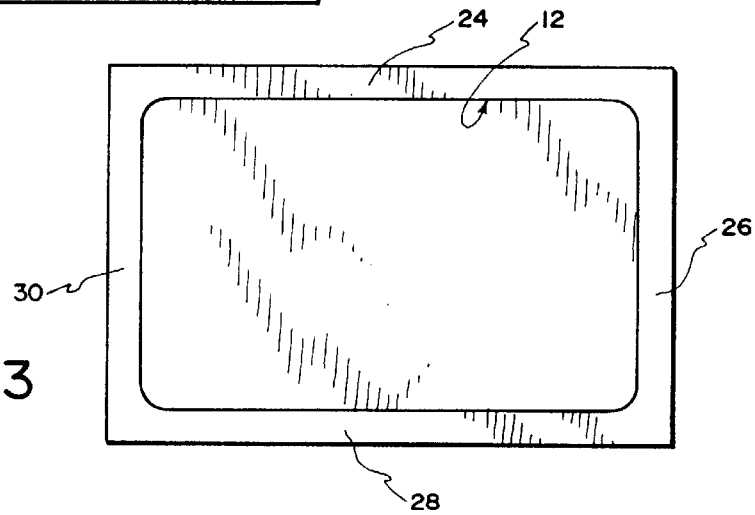
FIG. 3 is a bottom view of the rubber boot shown in FIG. 1.
Figure 5:
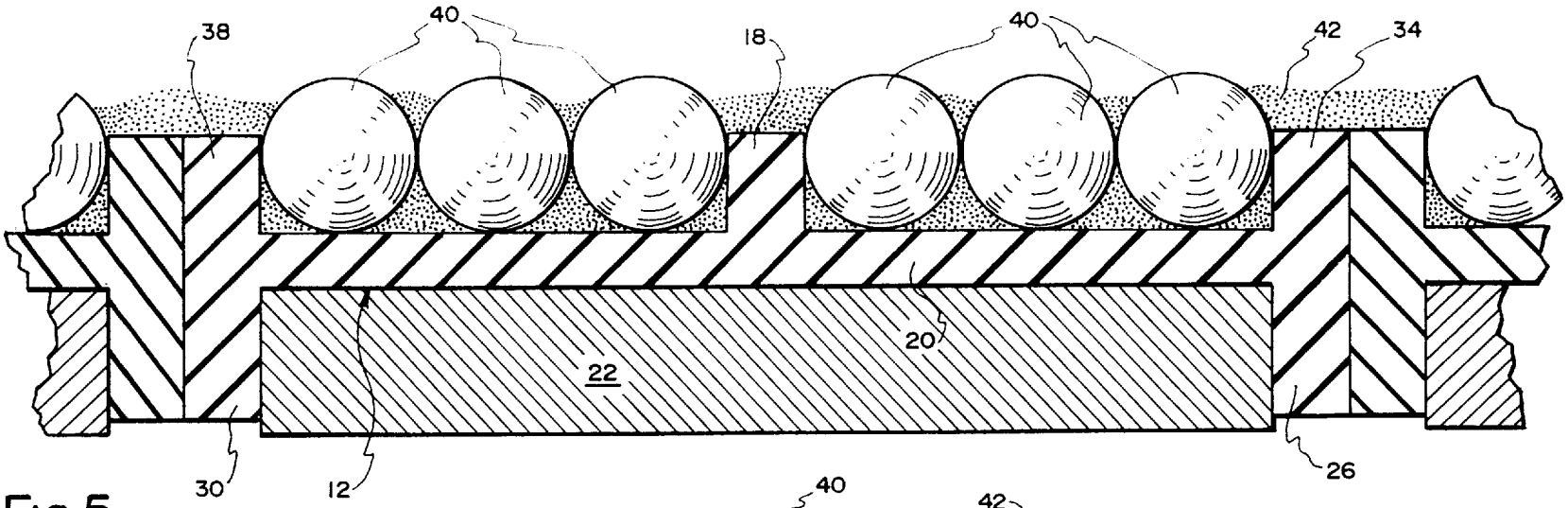
FIG. 5 is a sectional side elevation view, taken along the line 5—5 of FIG. 4, of the trunnion liner apparatus of FIG. 5.

As shown in FIGS. 1–5, the trunnion liner apparatus of the present invention includes a main body portion in the form of a rubber boot 10 having a main lower pocket 12 and a pair of upper cavities 14, 16. The upper pockets 14, 16 are separated by a middle rib-like structure 18. The upper cavities 14, 16, and the main pocket 12 are separated by a partitioning wall 20 (FIG. 5). The lower main pocket 12 is sized to securely hold a magnetic block 22. The magnetic block enables the trunnion liner apparatus to be removably securable to an inside wall of a trunnion. The walls 24, 26, 28, 30 which form the outer peripheries of the lower main pocket 12 are slightly smaller in height as compared to the thickness of the magnetic block 22 to ensure that the magnetic material comes in direct contact with the trunnion liner apparatus. The thicknesses of walls 24, 26, 28, 30 is approximately ¼ inch in a preferred embodiment. Further, the inside dimensions of main pocket 12 are slightly undersized as compared to the outside dimensions of the magnetic block 22 such that an interference fit holds the magnetic block inside the pocket 12.

In one embodiment, the dimensions of the magnetic block 22 are approximately six inches by four inches by one inch. The magnetic block may be made out of any suitable material, such as magnetic ceramic material, or any other material in which magnetic material is disposed. The magnetic material may comprise layers of magnetic material or interdispersed particles of magnetic material inside the block. Still further, rather than being a single block of material, the magnetic material could be installed into the rubber boot in various configurations with respect to size and frequency without departing from the scope of the present invention.

The upper cavities 14, 16 are formed, respectively, by walls 32, 34, 36, 38 which, along with middle rib 18. The walls and rib define the outer peripheries of cavities 14 and 16. The cavities are approximately ½ inch deep and have a cross-section of approximately 3⅝ inches by 2½ inches. The height of walls 32, 34, 36, 38, and rib 18 are approximately ½ inch.

Figure 4:
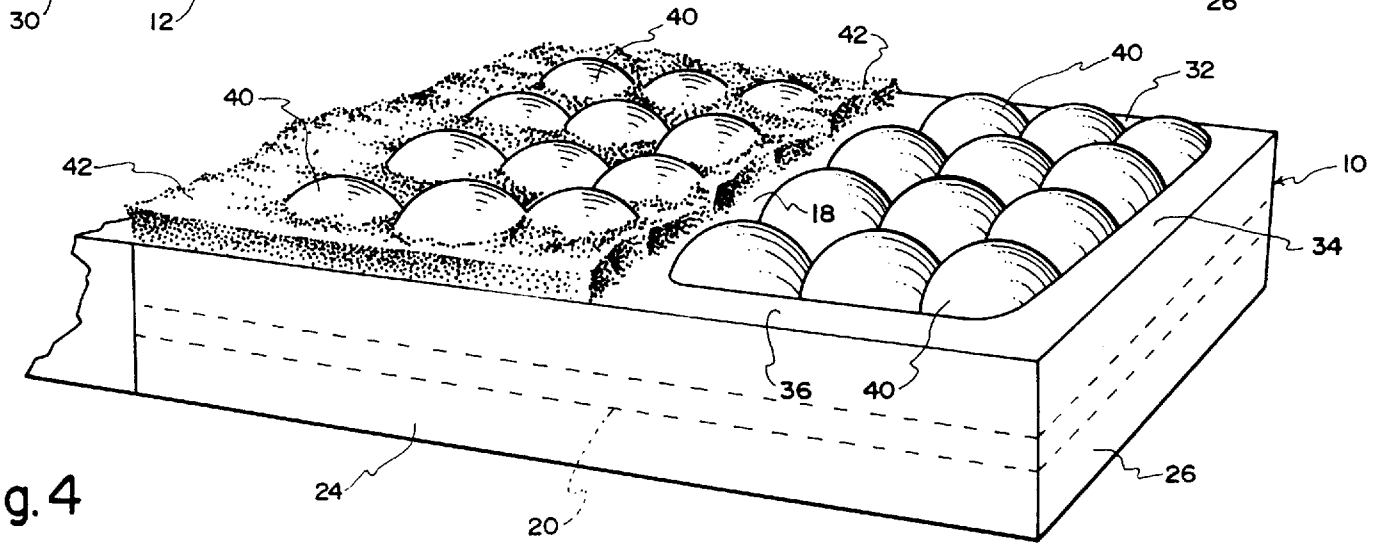
FIG. 4 is a perspective view of the trunnion liner apparatus according to the present invention with steel balls held within the pair of cavities formed in the rubber boot and the processed material held within the cavities and in between the steel balls.

As shown in FIGS. 4 and 5, a plurality of steel balls 40 are placed inside the upper twin pockets 14, 16. The steel balls are held in place inside the upper pockets by means of the magnetic attraction created by the magnetic block of material 22. The steel balls are also held in place in part by the surrounding outer walls. As processed material is being directed from the ball mill through the trunnion toward the trommel, particulate matter 42 of the processed material is lodged between the steel balls 40 and the trunnion liner apparatus 10. The layer of processed material, in combination with the steel balls 40, create a wear surface such that the life of the trunnion liner 10 is substantially augmented.

The layer of processed material 42 may partially cover the steel balls 40 (as shown in FIGS. 4 and 5) or the processed material 42 may entirely cover the steel balls. The processed material may comprise any desirable material, such as precious minerals, ores, and the like. The processed material may be magnetic, non-magnetic, or magnetizable.

Figure 6:
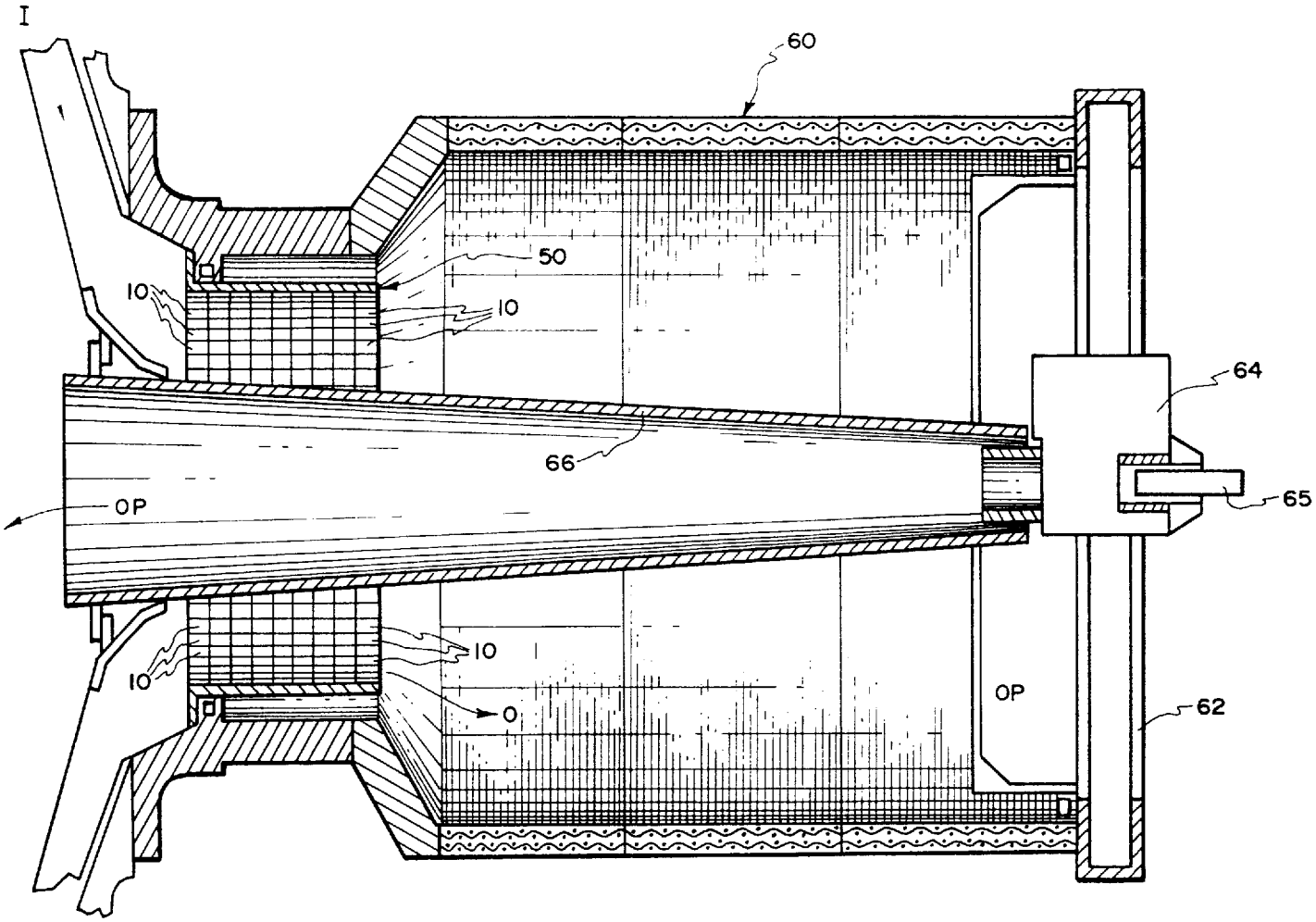
FIG. 6 is a sectional side elevation view of a materials handling system according to the present invention, including a trunnion which directs processed material from a ball mill discharge to a trommel which separates large particles of process ed material from appropriately sized particles of processed material.

As shown in FIG. 6, the trunnion liner apparatus of the present invention is installed on a trunnion 50 by placing a plurality of trunnion liner devices 10 in rows and columns on the inside surface of the cylindrical trunnion liner device. In the embodiment shown in FIG. 6, 9 rows of liners are positioned across the trunnion. An incoming string of processed material (I) flows toward the trunnion 50 and is directed toward a trommel 60 via an outlet flow (O) from the trunnion. The trommel 60 may be any conventional trommel. In the embodiment of FIG. 6, the trommel includes a plurality of screens through which undersized product (UP) passes. Oversized product (OP) passes to an oversize return bucket 62 which deposits the oversize product into a stationary oversize rock box 64. The oversize product (OP) then passes through a conically shaped chute 66 with the aid of a water jet 65 toward the ball mill for further processing.

It should also be understood that the ball mill (not shown) may be any suitable ball mill or any suitable material processing device. The material being handled is processed according to standard processing techniques. The inventive aspect of the present invention specifically relates to lining of an inside surface of a trunnion. The trunnion liner apparatus 10 may be used in connection with any suitable trunnion used in material handling systems.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

I claim:

1. A trunnion liner apparatus, comprising:

a main body portion;

a main pocket formed in the main body portion;

a magnetic block held within the main cavity, the magnetic block being removably securable to a wall of a trunnion;

at least one cavity formed in the main body portion, the cavity retaining a bed of material which prevents wear on a trunnion surface.

2. A trunnion liner apparatus according to claim 1, further comprising:

a plurality of cavities formed in the main body portion, each cavity sized to retain a bed of material which prevents wear on a trunnion surface.

3. A trunnion liner apparatus according to claim 1, further comprising:

a plurality of cavities formed in the main body portion, each cavity sized to retain a bed of material which prevents wear on a trunnion surface;

a partitioning wall formed in the main body separating each of the cavities.

4. A trunnion liner apparatus according to claim 3 wherein the number of cavities comprises two.

5. A trunnion liner apparatus according to claim 1 wherein the bed of material comprises ore material being handled by a trunnion.

6. A trunnion liner apparatus according to claim 1 wherein the bed of material comprises a plurality of steel balls.

7. A trunnion liner apparatus according to claim 1 wherein the bed of material comprises a plurality of steel balls and processed material interdispersed between the steel balls.

8. A trunnion liner apparatus according to claim 1 wherein the main body portion comprises a rubber boot.

9. A trunnion liner apparatus according to claim 1 wherein the main body portion comprises a rubber boot, the magnetic block being held within the main pocket of the rubber boot by an interference fit.

10. A trunnion liner apparatus, comprising:

a rubber boot;

a magnetic material;

a first receptacle area to receive the magnetic material, the magnetic material enabling the trunnion liner apparatus to be removably secured to an inside wall of a trunnion;

a bed of wear reducing material;

a second receptacle area to receive the bed of wear reducing material which prevents wear on a trunnion surface.

11. A trunnion liner apparatus according to claim 10 wherein the second receptacle comprises a plurality of cavities formed in the rubber boot.

12. A trunnion liner apparatus according to claim 10 wherein the second receptacle comprises a plurality of cavities formed in the rubber boot and further comprising a partitioning wall formed in the rubber boot to separate each of the cavities.

13. A trunnion liner apparatus according to claim 10 wherein the bed of wear reducing material comprises ore material being handled by a trunnion.

14. A trunnion liner apparatus according to claim 10 wherein the bed of wear reducing material comprises a plurality of steel balls.

15. A trunnion liner apparatus according to claim 10 wherein the bed of wear reducing material comprises a plurality of steel balls and processed material interdispersed between the steel balls.

16. A trunnion liner apparatus according to claim 10 wherein the magnetic material is held within the first receptacle area of the rubber boot by an interference fit.

* * * * *